US012546221B2

(12) United States Patent
Slettebø

(10) Patent No.: US 12,546,221 B2
(45) Date of Patent: Feb. 10, 2026

(54) POSITIVE DISPLACEMENT ROTARY MACHINE

(71) Applicant: Tocircle Industries AS, Oslo (NO)

(72) Inventor: Nikolai Slettebø, Kolsås (NO)

(73) Assignee: Tocircle Industries AS, Oslo (NO)

( * ) Notice: Subject to any disclaimer, the term of this patent is extended or adjusted under 35 U.S.C. 154(b) by 0 days.

(21) Appl. No.: 18/861,324

(22) PCT Filed: Apr. 27, 2023

(86) PCT No.: PCT/NO2023/050097

§ 371 (c)(1),
(2) Date: Oct. 29, 2024

(87) PCT Pub. No.: WO2023/211290

PCT Pub. Date: Nov. 2, 2023

(65) Prior Publication Data

US 2025/0290420 A1 Sep. 18, 2025

(30) Foreign Application Priority Data

Apr. 29, 2022 (NO) ..... 20220490

(51) Int. Cl.
*F01C 1/32* (2006.01)
*F01C 1/46* (2006.01)
(Continued)

(52) U.S. Cl.
CPC ..... *F01C 1/32* (2013.01); *F01C 1/46* (2013.01); *F01C 21/008* (2013.01); *F01C 21/08* (2013.01)

(58) Field of Classification Search
CPC ..... F01C 1/32; F01C 1/46; F01C 21/008; F01C 21/08
See application file for complete search history.

(56) References Cited

U.S. PATENT DOCUMENTS 781,342 A 1/1905 Hoffman
922,189 A 5/1909 Pratt
(Continued)

FOREIGN PATENT DOCUMENTS

CH 504612 A 3/1971
FR 2048720 A5 * 3/1971
(Continued)

OTHER PUBLICATIONS

English Translation FR-2048720-A5 (Year: 1971).*
International Search Report dated Aug. 7, 2023 for Tocircle Industries AS, International Patent Application No. PCT/NO2023/050097, filed Apr. 27, 2023.
(Continued)

*Primary Examiner* — Shafiq Mian
(74) *Attorney, Agent, or Firm* — Law Office of Albert Wai-Kit Chan, PLLC

(57) ABSTRACT

A rotary machine for fluid processing, comprising a static casing (2) with a first and second port (H, L) for allowing fluid out of and into the rotary machine. The rotary machine comprises a rotor body (4, 4') attached to a main shaft (3) arranged within the static casing (2), the rotor body (4, 4') has a center axis (R) arranged an offset distance (e) from a center axis (M) of the main shaft (3), the rotary machine further comprising a sealing vane (5, 5') having a vane tip (6, 6'), and a vane moving system (8, 8') operationally connected between the rotor body (4, 4') and the sealing vane (5, 5') for maintaining a vane tip seal face (6*a*, 6*c*) of the vane tip (6, 6') in a sealing proximity to the rotor body outer face (4*a*, 4*b*).

5 Claims, 8 Drawing Sheets

(51) Int. Cl.
*F01C 21/00* (2006.01)
*F01C 21/08* (2006.01)

(56) References Cited

U.S. PATENT DOCUMENTS

| | | | | |
|---|---|---|---|---|
| 3,081,707 | A | 3/1963 | Marshal | |
| 2005/0000214 | A1 | 1/2005 | Driver | |
| 2008/0019820 | A1 * | 1/2008 | Patterson | F04C 2/321 415/62 |
| 2012/0224989 | A1 * | 9/2012 | Akmandor | F01C 1/39 418/12 |
| 2017/0130716 | A1 * | 5/2017 | Akmandor | F01C 1/356 |

FOREIGN PATENT DOCUMENTS

| | | | | |
|---|---|---|---|---|
| GB | 273439 | | 7/1927 | |
| GB | 600383 A | * | 4/1948 | F01C 1/46 |
| NO | 744622 L | | 7/1974 | |

OTHER PUBLICATIONS

International Preliminary Report on Patentability dated Jul. 24, 2024 for Tocircle Industries AS, International Patent Application No. PCT/NO2023/050097, filed Apr. 27, 2023.
Norwegian Search Report dated Apr. 30, 2024 for Tocircle Industries As, Norwegian Patent Application No. NO20220490, filed Apr. 29, 2022.
Norwegian Search Report dated Nov. 29, 2022 for Tocircle Industries As, Norwegian Patent Application No. NO20220490, filed Apr. 29, 2022.

* cited by examiner

POSITIVE DISPLACEMENT ROTARY MACHINE

TECHNICAL FIELD

The invention relates to a positive displacement rotary machine. Preferably, the positive displacement rotary machine is intended to be used as a compressor and/or expander for gases or gas/liquid mixtures, or as a pump and/or hydromotor for liquids.

BACKGROUND ART

Rotary machines with an eccentric rotor rotating around the centre axis of a cylindrical casing are well known and widely applied as, e.g., compressors in heating and cooling processes. In rotary machines of this type, a closed working chamber is formed between the three main parts; a static casing with a substantially cylindrical inner bore, a rotor, also cylindrical and with a diameter smaller than the casing bore, eccentrically fixed to a shaft rotatable around the casing bore centre in such a way that the rotor outer wall tangents the casing inner wall, and a movable member or vane sealing between the casing and rotor. Each part must seal towards the two other parts to form a closed working chamber between them, and as the rotor rotates, the working chamber changes volume to compress or expand the processed working fluid Such machines are generally regarded as reliable and robust equipment, but mostly relies on a direct contact between the rotor and a sealing vane to provide sufficient sealing of the working chamber. This contact causes friction and sets a limit to the size and volumetric capacity of the machine or makes it necessary to introduce a lubricant directly into the working chamber or in the working fluid.

The present invention is advantageous (at least) in that it provides a way for the parts forming the working chamber to always remain in sealing proximity throughout the working cycle without the need for contact between them. Parts in sealing proximity is to be understood as parts being in light or no contact but still forming no gap between them or a small enough gap to prevent excessive leakage of fluid in the gap. Hence there is no friction between these parts and no need to introduce lubricant into the working chamber. The three parts forming the working chamber is a static casing, a rotating rotor, and an oscillating vane. Both the rotor and the oscillating vane are fixed to shafts, and a conrod connects these shafts to control the oscillating movement of the vane. Geometric relations between the parts ensures that the curved faces of the stator, rotor and vane will tangent each other and seal the working chamber.

A further advantage of the present invention is that the two mentioned shafts can easily be sealed around by conventional shaft seals, thus effectively isolating all bearing functions from the working chamber, allowing lubrication of the bearings while keeping the working chamber free from lubricant The invention is further advantageous in that it provides a method of contact-free and adjustable support of the vanes oscillating motion relative to the casing, that increases the control of the vane position and reduces the forces on the conrod and the conrod bearings Further and other objects of the invention may be apparent by the following description and drawings.

SUMMARY OF INVENTION

The invention relates to a rotary machine for fluid processing, comprising a static casing with a first and second port for allowing fluid out of and into the rotary machine, a rotor body attached to a main shaft arranged within the static casing, the rotor body has a center axis arranged an offset distance from a center axis of the main shaft.

The rotary machine further comprising a sealing vane having a vane tip, and a vane moving system operationally connected between the rotor body and the sealing vane for maintaining a vane tip seal face of the vane tip in a sealing proximity to the rotor body outer face.

The invention relates to a rotary machine for fluid processing, comprising a static casing with a first port and a second port for allowing fluid out of and into the rotary machine; the rotary machine comprising a rotor body attached to a main shaft, said main shaft being arranged within said static casing; said main shaft having a rotational centre axis which is coincident with a centre axis of a casing bore in said static casing; said rotor body having a first geometric center arranged an offset distance from said rotational center axis of said main shaft; the rotary machine further comprising a sealing vane having a vane tip; and a vane moving system operationally connected between said rotor body and said sealing vane for maintaining a vane tip seal face of said vane tip in a sealing relationship with said rotor body; said rotor body having a cross section with two different circular cylinder segments, a first segment with an outer surface having a geometric center coinciding with said first geometric centre, and a second segment with an outer surface having a second geometric centre coinciding with said rotational centre axis, and said second segment outer surface being concentric to and co-radial with said casing bore to seal against a casing inner wall of said bore at all rotational positions of said rotor body; said vane moving system comprising at least one connecting rod operationally connected at a first end to said rotor body: said at least one connecting rod being connected to a crank portion on said main shaft, said crank portion being concentric with said first segment outer surface of said rotor body.

The invention distinguishes from prior art by two alternative vane designs, wherein said vane tip seal face having a semi-circular cylindrical seal face, facing said first segment outer surface of said rotor body, and

- in the first alternative, said vane tip seal face having a radius; said connecting rod at a second end thereof being operationally connected to a pivot arm at a cross pin thereof; said pivot arm being rigidly connected to said vane; said cross pin being concentric with said semi-circular face of said vane tip, and a length of said connecting rod between the center axes of said crank portion and said cross pin being equal to a radius of said first segment outer surface plus the radius of the vane tip; and
- in a second alternative, said vane tip comprising a vane tip element that is rotatable relative to said vane, said vane tip element having a first semi-circular cylindrical face that is concentric with an axis of rotation between said vane tip element and said vane, said vane tip element being fixedly connected to said connecting rod, said vane tip element having a second semi-circular cylindrical seal face that is concentric and co-radial with said first segment outer face of said rotor body.

Preferable embodiments are set out in the accompanying dependent claims.

The positive displacement rotary machine may be a compressor or an expander.

When the rotary machine is a compressor, the second port is an outlet port preferably having a valve adapted to open when the pressure inside the rotary machine exceeds the pressure downstream the outlet valve.

When the rotary machine is an expander, the second port is an inlet port preferably having a control valve adapted to be open at a given position, such as a mechanical control set by a rotor position.

DETAILED DESCRIPTION OF THE INVENTION

For simplicity, equal features have been referred to by equal reference numbers in the different figures.

Figure 1:
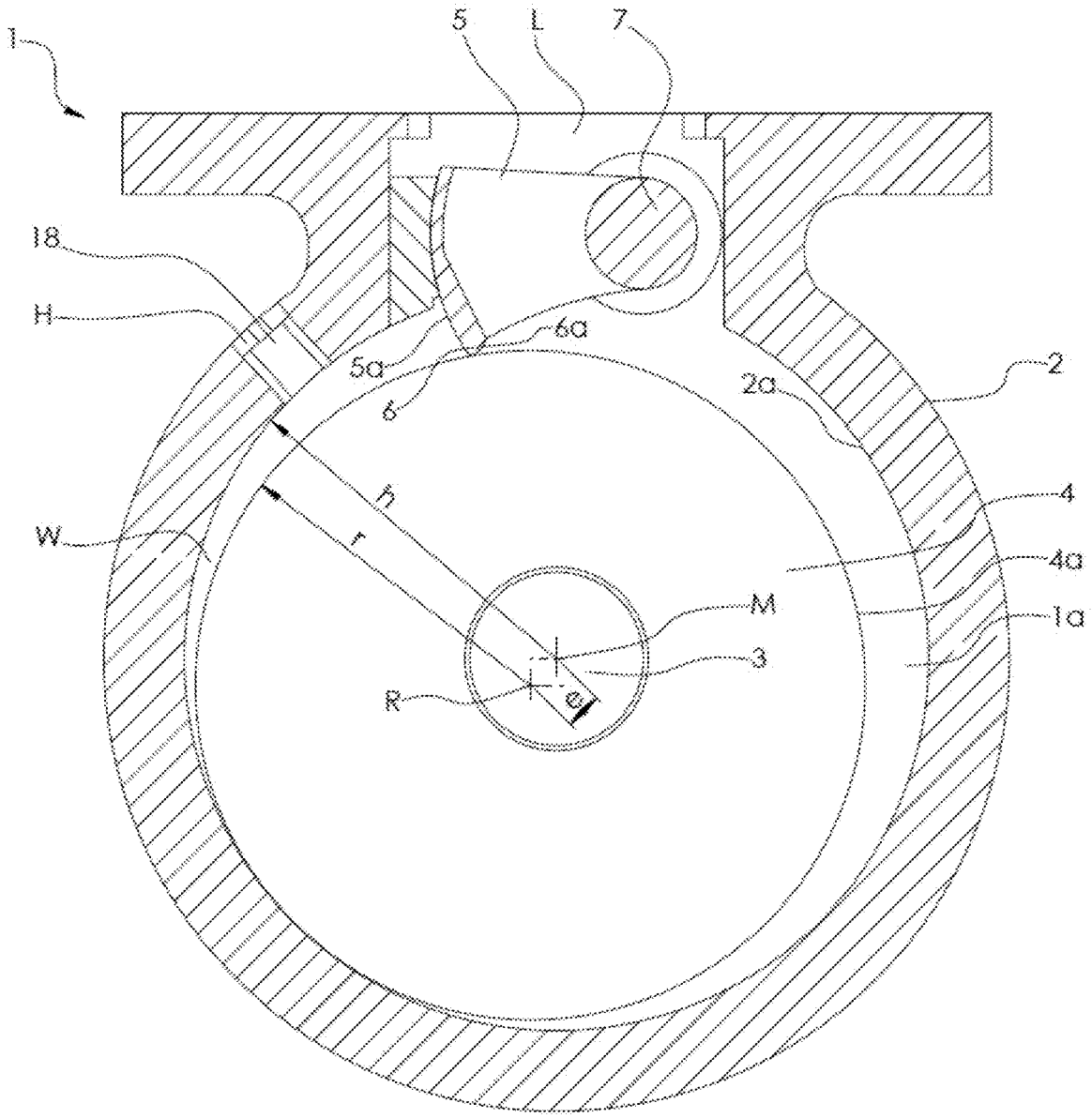
FIG. 1 shows a cross sectional view of a rotary machine, illustrating a vane according to the first alternative, viewed from the end.

FIG. 1 shows a cross section of a positive displacement rotary machine 1 having a vane according to the first alternative.

The rotary machine 1 comprises an outer casing 2 with a cylindrical inner wall 2*a*. The outer casing 2 having a first port L and a second port H. The first and second port L, H are adapted to let a working fluid F into and out of the casing 2. The direction of the fluid F through each port L, H depends on the use of the rotary machine 1. The reference number 18 refers to a valve arrangement that is arranged in association with the port H to let the working fluid into or out of the casing 2.

The rotary machine 1 further comprises a main shaft 3 rotatably supported in the outer casing 2. The main shaft 3 is concentrically arranged within a casing bore 1*a*. The casing bore 1*a* is defined as the bore within the outer casing 2. The outer boundary of the casing bore 1*a* is the same as the cylindrical inner wall 2*a*. A centre axis M (FIG. 2) through the main shaft 3 is thus coincident with the centre axis M of the casing bore 1*a*. The centre axis M has a distance h to the cylindrical inner wall 2*a*.

A rotor body 4 is further attached to the main shaft 3.

As shown in FIG. 1, the rotor body outer surface 4*a* is mainly cylindrical, with a geometric centre R parallel to and offset from a rotational centre axis M. A radius r of the rotor body outer surface 4*a* and the rotor offset e, is determined so that the part of the rotor body outer surface 4*a* furthest away from the rotational centre axis M is always in proximity to the casing inner wall 2*a*. This will create a seal between the casing inner wall 2*a*, and the rotor body outer surface 4*a*, without the rotor body 4 necessarily contacting the casing 2. This further results in that any friction between the rotor body 4 and the casing 2 may be avoided. The rotary machine 1 further comprises a sealing vane 5. The sealing vane 5 is pivotably supported in the casing 2, by means of a vane shaft 7. The vane shaft 7 has a pivot axis V (see FIG. 2) that is parallel to and spaced apart from the rotational centre axis M of the main shaft 3.

The sealing vane 5 comprises a vane tip 6 arranged at the free end of the sealing vane 5, i.e., at the opposite end of the pivot axis V. The vane tip 6 may have a semi-circular cylindrical outer surface 6*a*. The sealing vane 5 is further arranged in the static casing 2 so that a vane tip outer surface 6*a* (see FIG. 8) is always in sealing proximity to the rotor body outer surface 4*a*, hence forming a seal between the rotor body 4 and the vane 5. This is further illustrated in FIG. 1.

The sealing vane 5 also has a sealing face 5*a*. The sealing face 5*a* has a semi-circular cylindrical shape with its centre axis collinear with the centre axis V of the vane pivot axis. The sealing face 5*a* seals against a part 2*b* of the casing 2, effectively between the first and second port L, H.

Thus, a closed working chamber W is formed between the rotor body 4, the casing inner wall 2*a* and the vane 5. The volume of this working chamber W will increase or decrease as the rotor body 4 rotates, depending on the rotational direction, resulting in compression or expansion of the working fluid F.

Figure 4:
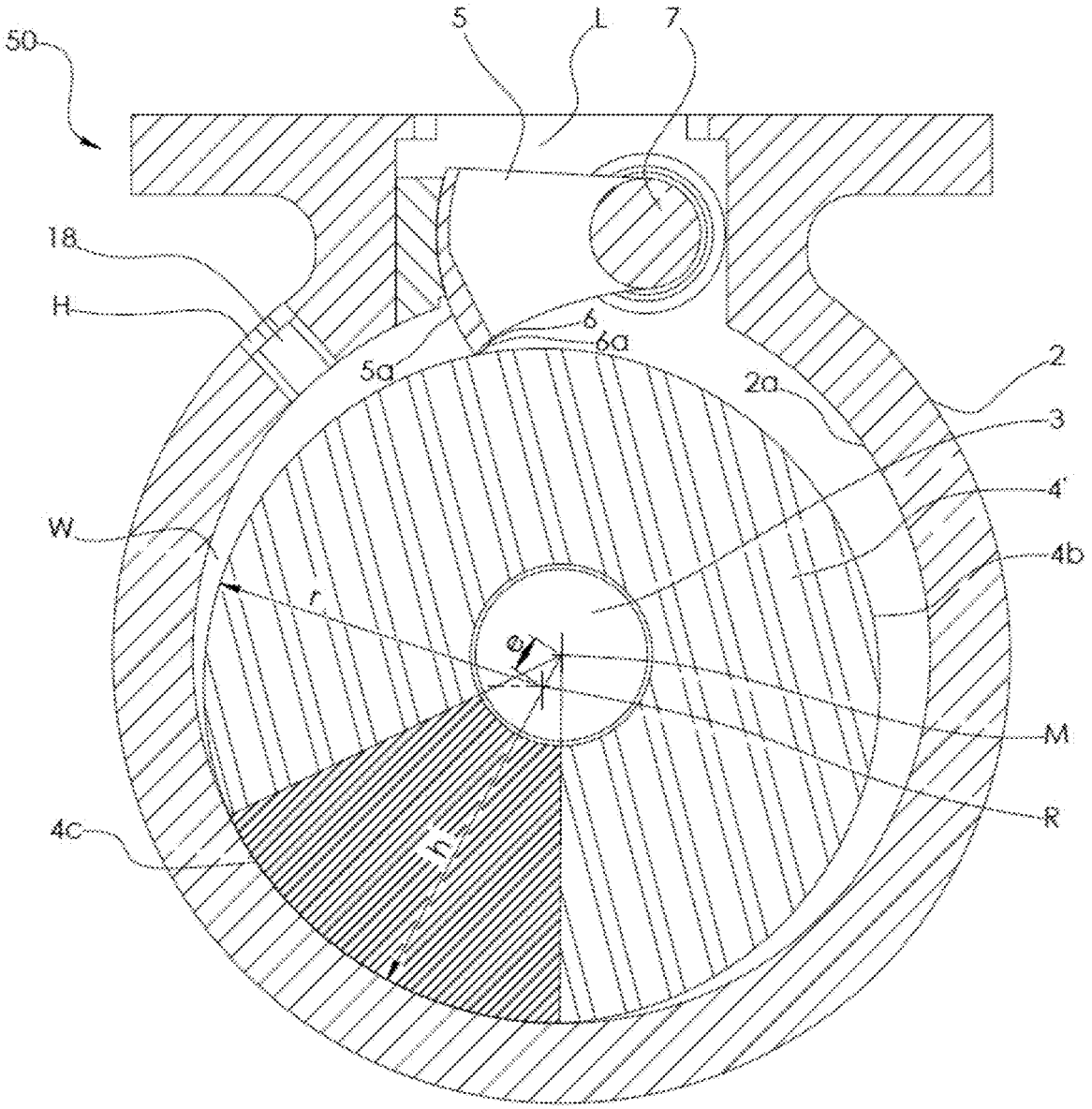
FIG. 4 shows a rotary machine with a rotor body according to the invention.

An embodiment, shown in FIG. 4, of the rotary machine 50, shows a different configuration of a rotor body 4'. In this embodiment the rotor body 4' does not have a cylindrical outer surface 4*a*. Instead, the rotor body has an approximately lens-shaped cross section. The shape comprises two different circular cylinder segments. The shape comprises a first segment with an outer surface 4*b* having its geometric centre R offset from the rotational centre axis M by a distance 'rotor offset' e, to form a seal against the sealing vane tip 6*a*. The rotor body further comprises a second segment with an outer face 4*c* concentric to and co-radial with the casing inner wall 2*a* to seal against the casing inner wall 2*a*.

Figure 2:
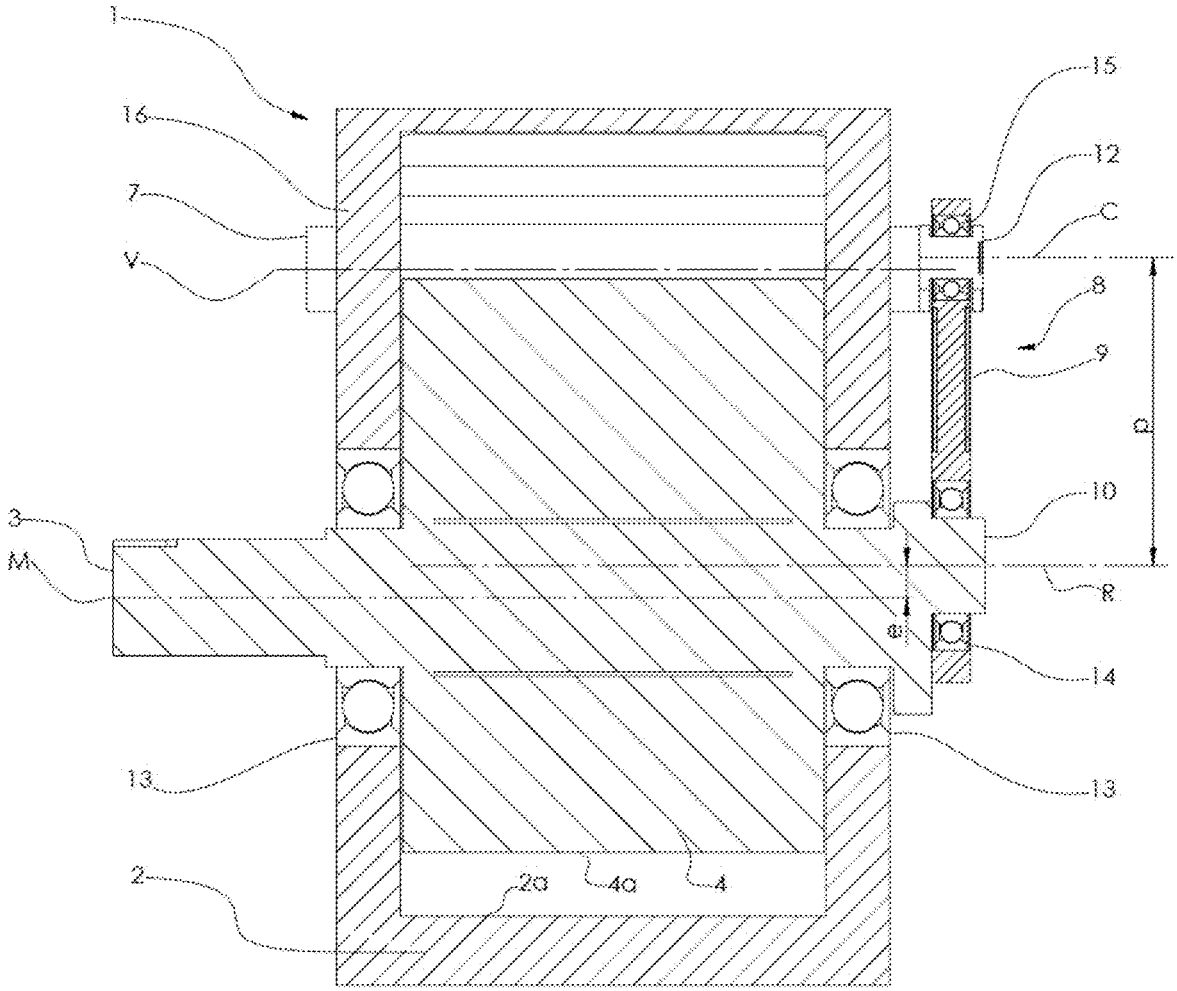
FIG. 2 shows a cross sectional view of the rotary machine from FIG. 1, viewed from the side.
Figure 3:
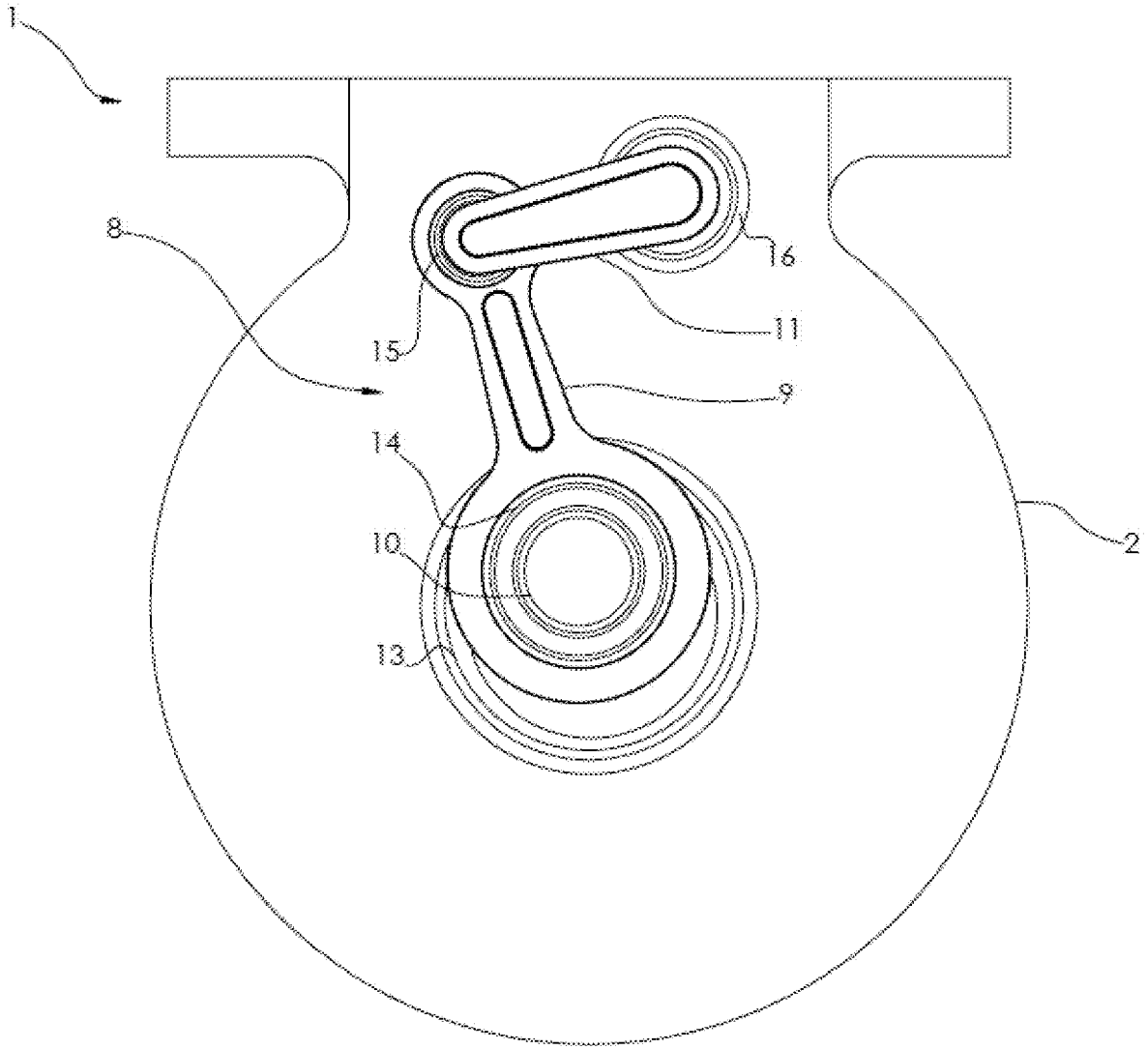
FIG. 3 shows the rotary machine from FIG. 1, viewed from the outside.

The rotary machine 1 may further comprise a vane moving system 8. A first embodiment of this is illustrated in FIGS. 2 and 3. The vane moving system 8 comprises one or more connecting rods 9. Each connecting rod 9 connecting the pivoting sealing vane 5 to a crank 10, via a pivot arm 11. The pivot arm 11 is rigidly mounted to the vane 5 in one end.

The pivot arm 11 and the connecting rod 9 are rotationally connected to each other in respective ends via a cross pin 12, as shown in the FIG. 2.

The connecting rod 9 is further in the opposite end rotationally connected to the crank 10.

The crank 10 may as the FIGS. 2 and 3 shows, be an integrated part of the main shaft 3. However, the center axis of the crank 10 is arranged offset of the rotational centre axis M of the main shaft 3. This result in an offset rotation of the crank 10 and a consequent linear motion of the connecting rod 9 when the main shaft 3 rotates. The crank offset distance is the same distance e as the distance between the centre axis of the main shaft M and the centre axis of the rotor body R.

The offset of the crank 10 being equal to the offset of the rotor body 4. This means that the geometrical center of the rotor body R and the center axis of the crank 10 being coincident.

FIGS. 1 to 4 shows one embodiment of the vane moving system 8 in which the cross pin 12 linking the connecting rod 9 to the pivot arm 11 is concentric with the semi-circular cylindrical shape of the vane tip sealing face 6*a*. The length P of the connecting rod 9 also being equal to the sum of the length of the rotor body radius r and the vane tip radius v (FIG. 1). The length P is defined as the distance between the geometrical center R and the axis C of the cross-pin 12. Thus, the connecting rod 9 will guide the pivoting sealing vane 5 so that the vane tip 6*a* is always tangent to the rotor body outer face 4*a*, creating a sealing line S (illustrated in FIG. 8) without the need for contact between the parts, i.e., rotor body 4 and the sealing vane tip 6*a*. This results in that no friction will occur between the vane tip 6*a* and the rotor body outer face 4*a*.

More precisely, the semi-circular cylindrical face of the vane tip 6*a* is always tangent to the cylindrical rotor body outer face 4*a*.

Figure 5:
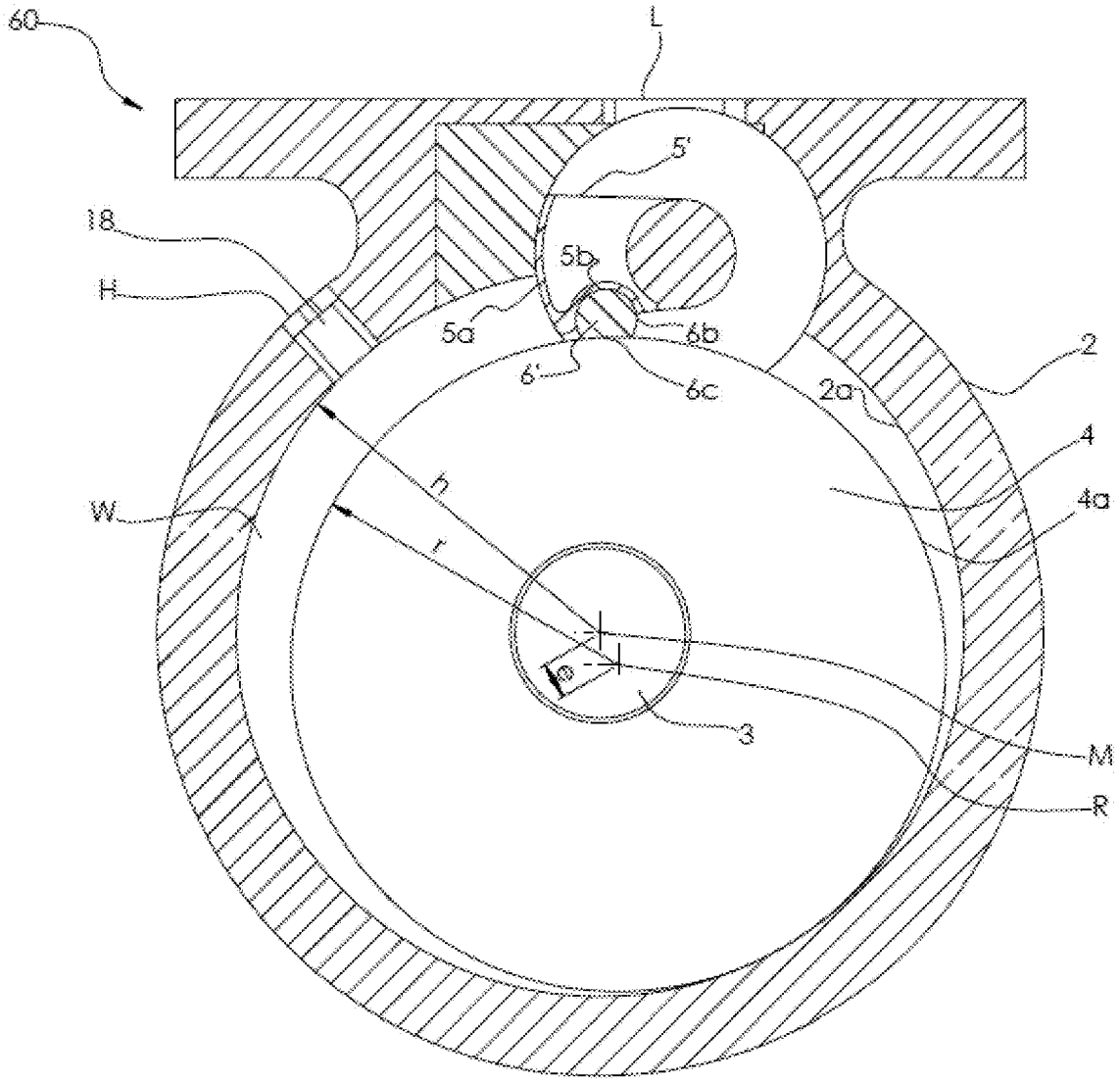
FIG. 5 shows a cross sectional view of a rotary machine, illustrating a vane according to the second alternative, viewed from the end.
Figure 6:
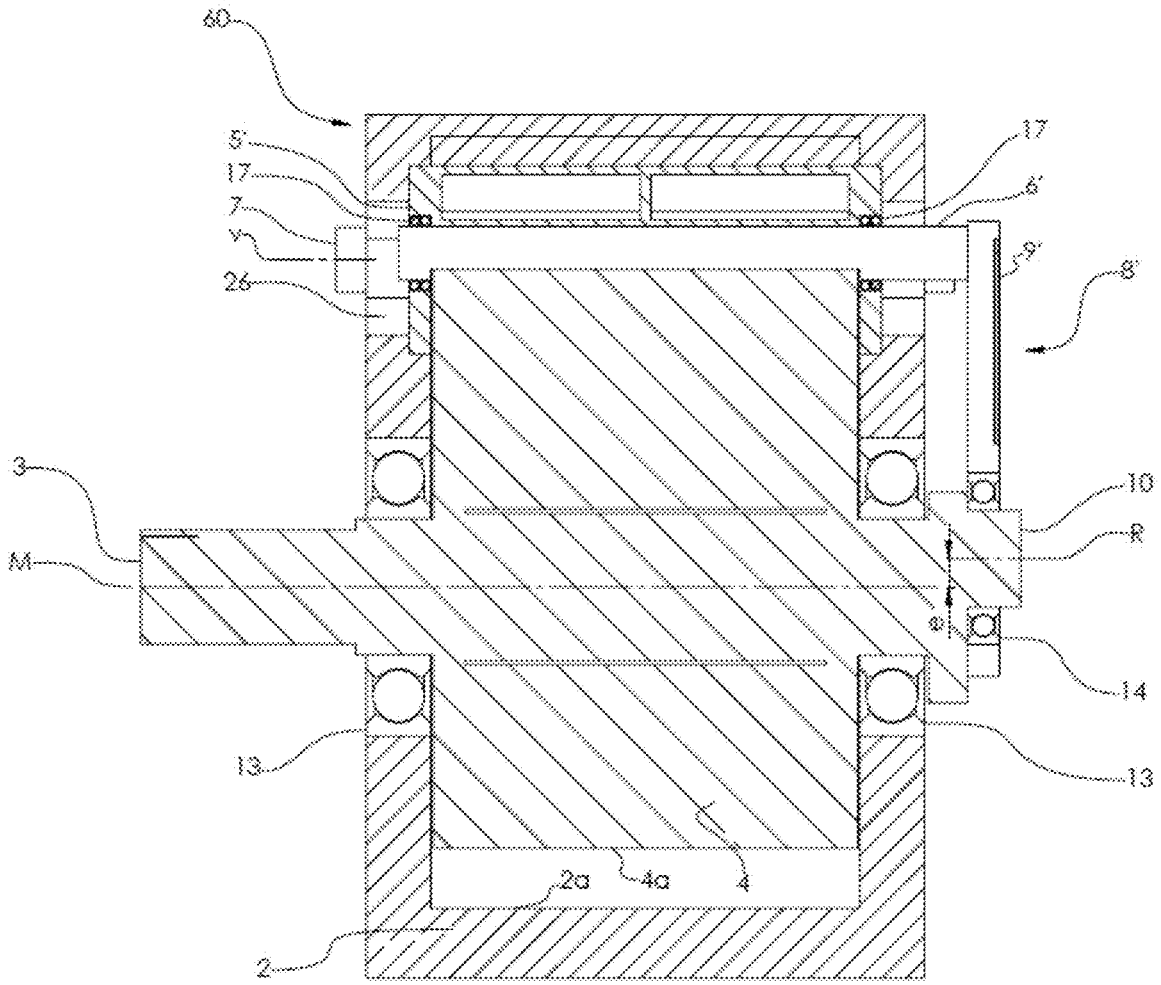
FIG. 6 shows a cross sectional view of the rotary machine of FIG. 5, viewed from the side.
Figure 7:
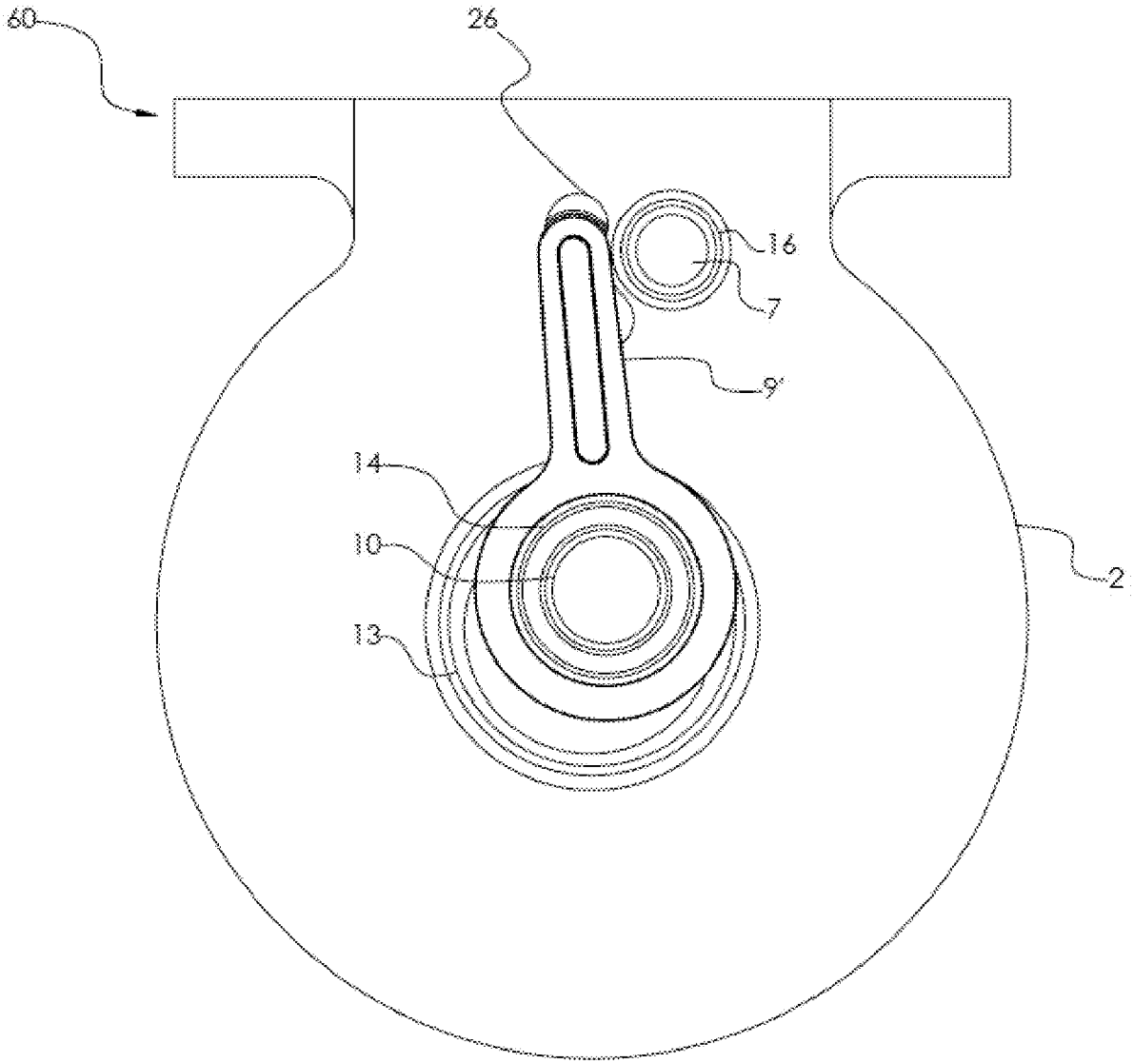
FIG. 7 shows the rotary machine of FIG. 5, viewed from the outside.

FIGS. 5 to 7 shows another embodiment of a sealing vane 5' and vane moving system 8' according to the invention.

In the embodiment the rotary machine 60 in FIG. 5-7 a vane tip 6' element is rigidly connected to the connecting rod 9'. The vane tip 6' element has a first semi-circular face 6*b* sealing against the vane 5', and a second semi-circular face 6*c* sealing against the rotor body outer face 4*a*. As the FIG. 5 shows, the first semi-circular face 6*b* is adapted to mate with a vane semi-circular face 5*b* of the vane 5'. Similarly, the second semi-circular face 6*c* is adapted to mate with the circular shape of the rotor body outer face 4*a*.

The vane tip 6' is connected to the vane 5' by the vane tip bearing 17 (FIG. 6), ensuring that the vane 5' will follow the motion of the vane tip 6'. This embodiment has the advantage that the vane tip second sealing face 6*c* may be both concentric and co-radial as the rotor body outer face 4*a*. This provides a better seal between the second sealing face 6*c* and the rotor outer face 4*a* than two faces having different radii, sealing only in a tangent line.

The following description is equally relevant for all the embodiments of the invention.

As the vane 5, 5' and the rotor body 4 are the only moving parts in the working chamber W, this means there is no need for contact between any moving parts of the working chamber W. Consequently, there is no need for lubricant here either and contamination of the working fluid can be avoided.

All relative motion between parts in the working chamber W is controlled by the main shaft 3 and vane moving system 8, 8'. All necessary bearing functions are handled by the main rotor bearing 13, crank bearing 14, vane shaft bearing 16 and connecting rod bearing 15 (for the embodiment shown in FIG. 1-4) or vane tip bearing 17 (for the embodiment shown in FIGS. 5-7). All these bearings can then be located away from the working chamber W. Since the motions of the rotor body 4 and the vane 5 are motions that may be transferred by the cylindrical shafts 3, 7, 6', 10, 12.

The bearings 13, 14, 15, 16, 17 may be oil lubricated and separated from the working chamber W by simple shaft seals. This is per se known.

The functioning of the vane moving system 8, 8' is thus so that it is linking the connection between the rotor body 4 and the vane tip 6, 6' without the need of connection inside the working chamber W. The connecting rod 9 is given an oscillating movement by the crank 10.

For the embodiment shown in FIG. 1-4, this provides an oscillating movement of the pivot arm 11 that is linked to the connecting rod 9. Since the pivot arm 11 is fixedly attached to the vane 5, the vane 5 will move accordingly.

For the embodiment shown in FIG. 5-7 the vane tip 6' is fixed to the connecting rod 9' and will move with it. The vane tip 6' element is rotatably connected to the vane 5', so that the oscillating motion of the connecting rod 9' and the vane tip 6' also provides an oscillating movement of the vane 5'. In FIG. 7 it is indicated a through hole, formed as a slot 26 in the static casing wall 2. The slot 26 defines the path where the part of the connection rod 9' that is connected to the vane 5', is able to move.

In all the embodiments, the elements of the vane moving device 8, 8' is arranged so that the rotor body 4, 4' and the vane 5, 5' moves by the vane moving device 8, 8' and not by any contact between the rotary body 4, 4' and the vane 5, 5'.

The rotary machine 1 may further comprise one or more vane support mechanisms 20 located in the interface between casing housing 2 and the vane 5. This is illustrated in detail in FIG. 8.

Figure 8:
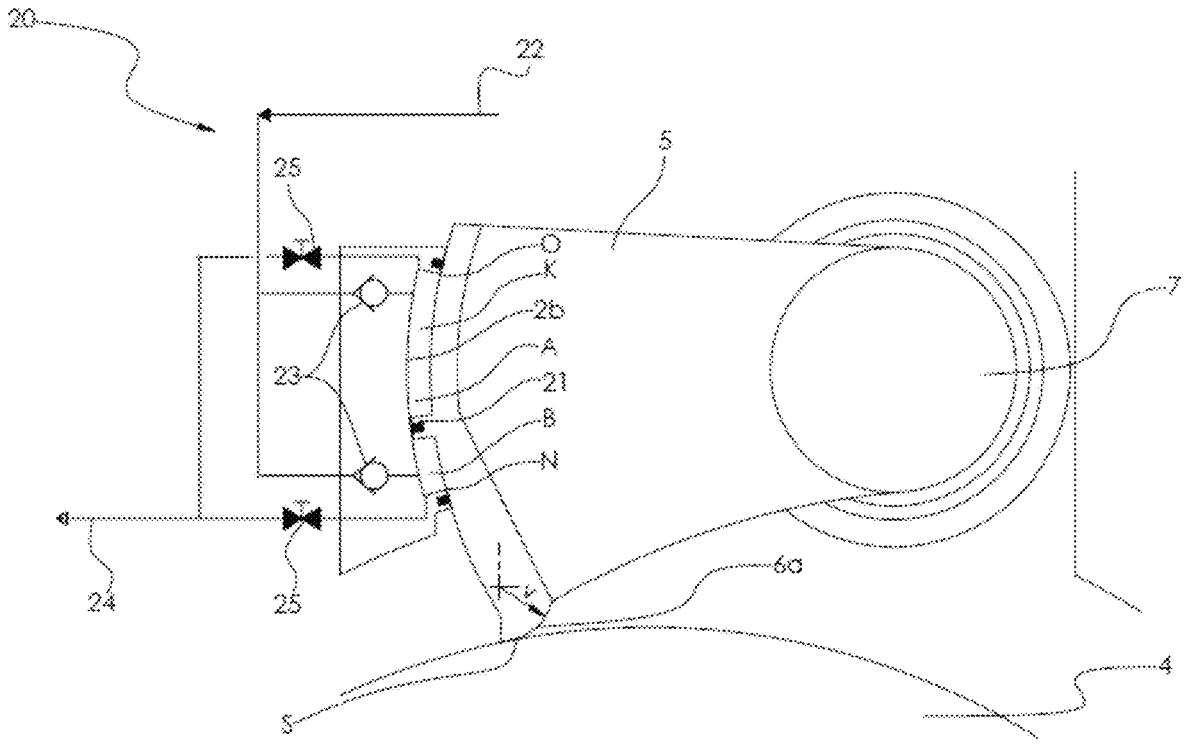
FIG. 8 shows a detailed view of an integrated vane support mechanism of the sealing vane.

FIG. 8 shows the vane support mechanism 20. The vane 5 may have a sealing protrusion 21 extending from the vane sealing face 5*a*. The protrusion 21 may for instance be positioned at the mid-point of the sealing face 5*a*.

The vane support mechanism 20 comprises a cavity K in the casing 2 in which the protrusion 21 can move freely within the pivot range of the sealing vane 5. The pivot range is the space within the cavity K between end positions O and N as indicated in the FIG. 8.

The protrusion 21 is adapted to seal against a cavity wall 2*b* effectively, forming two separate closed volumes A and B, that may be connected to the machines working chamber, and therefore containing the working fluid F.

The oscillating motion of the vane 5 causes large dynamic forces Fd on the vane 5 and vane movement system 8. The motion will also cause a compression of volume A and expansion of volume B, or vice versa, depending on the direction of the stroke. This produces a differential pressure between volume A and B, which again generates a force Fp on the protrusion 21. This force will counteract the dynamic forces Fd, and therefore greatly offload the vane 5 and vane moving system 8.

The vane support mechanism 20 further may comprise one or more fluid supply channels 22 connecting each of the two volumes A, B to a compressor port L or H (FIG. 1, 4, 5), for supplying fluid into the volumes A, B. There may further be non-return valves 23 in the fluid supply channels 22 to prevent backflow and flow between the volumes A, B. The vane support mechanism 20 may further have fluid return lines 24 connecting each volume to the compressor inlet and/or outlet port, a fixed or adjustable throttling device 25, such as a valve, in the fluid return lines 24, to set the maximum obtainable pressure in each volume.

Referring to FIG. 8, when the machine is operating, the vane 5 will oscillate so that the protrusion 21 moves between its upper position O and lower position N. The dynamic force Fd will be at its maximum in the direction away from the rotor body 4 when the protrusion 21 is at its upper position O, and its maximum in the direction towards the rotor body 4 when the protrusion is at its lower position b.

The vane support mechanism 20 uses the vane's 5 motion to fill and compress working fluid in the two volumes A, B on each side of the vane seal face protrusion 21.

As the protrusion 21 is at its upper position O, the volume A will be fully compressed, while the volume B will be uncompressed or expanded, depending on the settings of the throttling device 25. The pressure difference between the two volumes A, B acts on the protrusion 21, exerting a pressure force Fp on the vane 5 acting towards the rotor body 4, i.e., opposite of the dynamic force Fd.

As the vane 5 with the protrusion 21 moves from its upper position O towards its lower position N, the dynamic force Fd is gradually reduced, before changing direction and reaching its maximum in the direction towards the rotor body 4 when the protrusion 21 reaches its lower position N. At the same time the volume A is expanding, and volume B is compressed.

By selecting adequate width of the protrusion 21 and adjusting the max. pressure in the two volumes A, B, using e.g. the throttling devices 25, the force Fp from the vane support mechanism 20 can counteract the dynamic forces, and greatly reduce the total forces on the vane 5.

This is beneficial because it prevents unwanted clearance between the vane tip seal face 6*a* and the rotor body outer face 4*a*, arising from dynamic forces FD forcing the vane 5 away from the rotor body 4 as it moves towards its upper position O. In this part of the motion, the working fluid F in the working chamber W is at or close to its maximum pressure, so it is very important to minimize clearances to avoid volumetric losses.

Further the support mechanism 20 reduces forces on the connecting rod bearing 15 and vane tip bearing 17. This results in that smaller, lighter bearings and other moving parts can be used, which again means reduction of e.g., size, complexity, cost, and vibrations to the surroundings.

Even though the vane support mechanism 20 is illustrated with the vane embodiment from FIG. 1, the vane support mechanism is equally applicable for the vane embodiment illustrated in FIG. 5.

The positive displacement rotary machine 1 may be suitable for different purposes, for instance as a compressor and/or expander for gases of gas/liquid mixtures.

When working as a driven machine, e.g. compressor or pump, rotational motion is applied to the main shaft 3 by for example an electric motor, to rotate the rotor 4. When working as a driver, e.g. expander, the pressure in the working chamber W drives the rotor 4, and rotational motion is transferred via the main shaft 3 to a consumer, e.g. an electric generator.

Working fluid enters the machine through one of the first or second ports L or H, depending on whether the rotary machine 1 operates as a compressor or an expander.

In a compressor, the working fluid enters the working chamber W through the port L. The rotor body 4 rotates clockwise referring to FIG. 1. Once the sealing line or portion between the rotor body 4 and the casing 2 has moved past the port L, a closed working chamber W is formed between the rotor body 4, the static casing inner wall 2*a* and the sealing vane 5. The volume of this working chamber W will decrease as the rotor body 4 continues its rotation, and the pressure of the working fluid F entrapped in the working chamber W will increase. Once the required discharge pressure is reached, the working fluid F will exit through the second port H.

A valve arrangement 18 or similar in the high-pressure port H is necessary to control the machines volumetric ratio. When designed as a compressor, this can be standard compressor valves, or other types of reed valves or non-return valves that will open once the pressure in the working chamber W reaches or slightly exceeds the pressure downstream the valve 18. These types of valves require no further control mechanisms.

When working as an expander, the valves 18 may need to be controlled to open at a given position, e.g. by a mechanical control such as a cam shaft that sets the valve position based on the rotor body 4 position.

Even though the figures illustrate different embodiments, it is to be noted that the embodiments of the rotor body 4, 4' may be used in any of the embodiments 1-3 or 5-7.

For instance, the rotor body 4' of FIG. 5 may be used together with the vane of FIG. 5'.

The vane support mechanism may be used in all embodiments of the invention.

FIGURE LIST

1—rotary machine, first embodiment
2—static casing
2*a*—casing inner wall
2*b*—casing cavity seal face
3—main shaft
4—rotor body, first embodiment
4'—rotor body, second embodiment
4*a*—rotor seal face
4*b*—rotor body—vane seal face
4*c*—rotor body—casing seal face
5, 5'—sealing vane
5*a*—vane—casing seal face
5*b*—vane—vane tip seal face
6—vane tip, first embodiment
6'—vane tip, second embodiment
6*a*—vane tip—rotor seal face
6*b*—vane tip—vane seal face
6*c*—vane tip—rotor seal face, fixed vane tip
7—vane shaft
8—vane moving system, first embodiment
8'—vane moving system, second embodiment
9, 9'—connecting rod
10—crank
11—pivot arm
12—cross pin
13—main rotor bearing
14—crank bearing
15—connecting rod bearing
16—vane shaft bearing
17—vane tip bearing
18—valve
20—vane support mechanism
21—sealing protrusion
22—fluid supply channels
23—Flow restrictor, non-return valves
24—fluid return line
25—throttling device
26—slot
50—rotary machine, second embodiment
60—rotary machine, third embodiment
K—vane support mechanism chamber
A—first closed volume
B—second closed volume
O—vane protrusion upper position
N—vane protrusion lower position
S—sealing line
M—rotational center axis of main shaft and geometrical center axis of casing bore
R—geometrical center of rotor body and crank
C—center axis of cross pin and vane tip
V—center axis of vane shaft
W—working Chamber
F—working fluid
L—first port—Inlet fluid port/outlet fluid port
H—second port—outlet fluid port/inlet fluid port
P—length of connecting rod
Fd—dynamic forces on vane
Fp—force on vane arising from differential pressure on sealing protrusion 21
d—diameter of rotor body
e—rotor offset distance
c—casing inner bore radius r—rotor seal face radius v—vane tip radius f—offset distance between center axis of vane shaft and casing inner bore radius.

The invention claimed is:

1. A rotary machine for fluid processing, comprising a static casing with a first port and a second port for allowing fluid out of and into the rotary machine; the rotary machine comprising a rotor body attached to a main shaft, said main shaft being arranged within said static casing; said main shaft having a rotational center axis which is coincident with a center axis of a casing bore in said static casing; said rotor body having a first geometric center arranged an offset distance from said rotational center axis of said main shaft; the rotary machine further comprising a sealing vane having a vane tip; and a vane moving system operationally connected between said rotor body and said sealing vane for maintaining a vane tip seal face of said vane tip in a sealing relationship with said rotor body; said rotor body having a cross section with two different circular cylinder segments, a first segment with an outer surface having a geometric center coinciding with said first geometric center, and a second segment with an outer surface having a second geometric center coinciding with said rotational center axis, and said second segment outer surface being concentric to and co-radial with said casing bore to seal against a casing inner wall of said bore at all rotational positions of said rotor body; said vane moving system comprising at least one connecting rod operationally connected at a first end to said rotor body; said at least one connecting rod being connected to a crank portion on said main shaft, said crank portion being concentric with said first segment outer surface of said rotor body, wherein that said vane tip seal face having a semi-circular cylindrical seal face, facing said first segment outer surface of said rotor body;

in a first alternative, said vane tip seal face having a radius; said connecting rod at a second end thereof being operationally connected to a pivot arm at a cross pin thereof; said pivot arm being rigidly connected to said vane; said cross pin being concentric with said semi-circular face of said vane tip, and a length of said connecting rod between the center axes of said crank portion and said cross pin being equal to a radius of said first segment outer surface plus the radius of the vane tip; or in a second alternative, said vane tip comprising a vane tip element that is rotatable relative to said vane, said vane tip element having a first semi-circular cylindrical face that is concentric with an axis of rotation between said vane tip element and said vane, said vane tip element being fixedly connected to said connecting rod, said vane tip element having a second semi-circular cylindrical seal face that is concentric and co-radial with said first segment outer face of said rotor body.

2. The rotary machine according to claim 1, wherein the rotary machine further comprises a vane support mechanism located in the interface between said casing and said vane.

3. The rotary machine according to claim 2, wherein said vane support mechanism comprises a cavity defined in said casing, said cavity being open towards said vane, said cavity and a vane seal face forming a closed chamber; said vane having a protrusion extending into said cavity and forming a seal towards an inner wall of said cavity, thereby dividing said closed chamber into a first closed volume and a second closed volume.

4. The rotary machine according to claim 2, wherein said vane support mechanism further comprises a fluid adjusting arrangement providing adjustment of a pressure of said first and/or second volume to control the movement of the vane.

5. The rotary machine according to claim 3, wherein said vane support mechanism further comprises a fluid adjusting arrangement providing adjustment of a pressure of said first and/or second volume to control the movement of the vane.

* * * * *